US009878440B2

(12) United States Patent
Da Rosa

(10) Patent No.: US 9,878,440 B2
(45) Date of Patent: Jan. 30, 2018

(54) DRILL ATTACHMENT STORAGE DEVICE

(71) Applicant: Manuel P. Da Rosa, Vancouver (CA)

(72) Inventor: Manuel P. Da Rosa, Vancouver (CA)

( * ) Notice: Subject to any disclaimer, the term of this patent is extended or adjusted under 35 U.S.C. 154(b) by 70 days.

(21) Appl. No.: 15/087,528

(22) Filed: Mar. 31, 2016

(65) Prior Publication Data

US 2017/0282351 A1 Oct. 5, 2017

(51) Int. Cl.
*B25H 3/00* (2006.01)

(52) U.S. Cl.
CPC ..... *B25H 3/003* (2013.01)

(58) Field of Classification Search
CPC .. B25H 1/02; B25H 3/003; B25H 3/04; B25F 5/029; B65D 85/20; Y10S 206/806; Y10S 211/01; Y10S 224/904; Y10T 408/65; Y10T 408/96; Y10T 279/3443
USPC ..... 206/349–350, 362–363, 372–373, 206/378–379, 806; 211/57.1, 59.1, 69.1, 211/70.6, 87.01, 90.01–90.02, 106.1, 183, 211/706, DIG. 1; 224/223; 248/220.31, 248/220.41, 220.43, 245; 81/121.1, 184, 81/438, 490
See application file for complete search history.

(56) References Cited

U.S. PATENT DOCUMENTS 4,253,830 A * 3/1981 Kazen ..... A61C 3/04 206/368
4,932,294 A 6/1990 Chang
4,954,026 A * 9/1990 Zurwelle ..... B23B 45/006 206/373
D314,699 S * 2/1991 Tamosaitis ..... D8/70
5,056,661 A 10/1991 Balzano
5,230,261 A 7/1993 Akazawa et al.
D369,078 S 4/1996 Anderson
5,740,706 A * 4/1998 Tseng ..... B25B 15/04 81/177.4
5,810,525 A 9/1998 Ector, Sr.
6,250,466 B1 * 6/2001 Ernst ..... B25H 3/003 206/378
6,702,530 B2 3/2004 Bennage et al.
6,910,578 B2 * 6/2005 Stern ..... B25H 3/003 206/350
6,979,155 B2 12/2005 Dils et al.
8,066,268 B2 * 11/2011 Brauer ..... B25F 5/029 269/130
8,408,391 B2 4/2013 Drouin
2004/0206649 A1 * 10/2004 Chen ..... B25F 5/029 206/379

(Continued)

FOREIGN PATENT DOCUMENTS

EP 1105254 8/1999

*Primary Examiner* — Chun Cheung
*Assistant Examiner* — Brijesh V. Patel

(57) ABSTRACT

A drill attachment storage device for drill-couplable drill attachment storage includes a coupler that is coupled to a back of a housing proximate to a top of the housing. A plurality of penetrations is positioned on opposing sides of housing and extends through the housing. The penetrations are complementary to a shaft of a drill attachment. Each penetration is configured to reversibly couple a respective drill attachment. The coupler is configured to reversibly couple to a drill. The housing is positioned to store drill attachments such that the drill attachments are readily accessible to a user of the drill.

15 Claims, 3 Drawing Sheets

(56) References Cited

U.S. PATENT DOCUMENTS

| | | | | |
|---|---|---|---|---|
| 2005/0242145 | A1* | 11/2005 | Wang | B25H 3/003 224/666 |
| 2009/0026155 | A1* | 1/2009 | Bernard | E06C 7/14 211/70.6 |
| 2012/0037386 | A1* | 2/2012 | Cook | B23B 45/001 173/30 |
| 2014/0076833 | A1* | 3/2014 | Kao | A47B 81/00 211/70.6 |

* cited by examiner

DRILL ATTACHMENT STORAGE DEVICE

BACKGROUND OF THE DISCLOSURE

Field of the Disclosure

The disclosure relates to drill accessories and more particularly pertains to a new drill accessory for drill-couplable drill attachment storage.

SUMMARY OF THE DISCLOSURE

An embodiment of the disclosure meets the needs presented above by generally comprising a coupler that is coupled to a back of a housing proximate to a top of the housing. A plurality of penetrations is positioned on opposing sides of housing and extends through the housing. The penetrations are complementary to a shaft of a drill attachment. Each penetration is configured to reversibly couple a respective drill attachment. The coupler is configured to reversibly couple to a drill. The housing is positioned to store drill attachments such that the drill attachments are readily accessible to a user of the drill.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
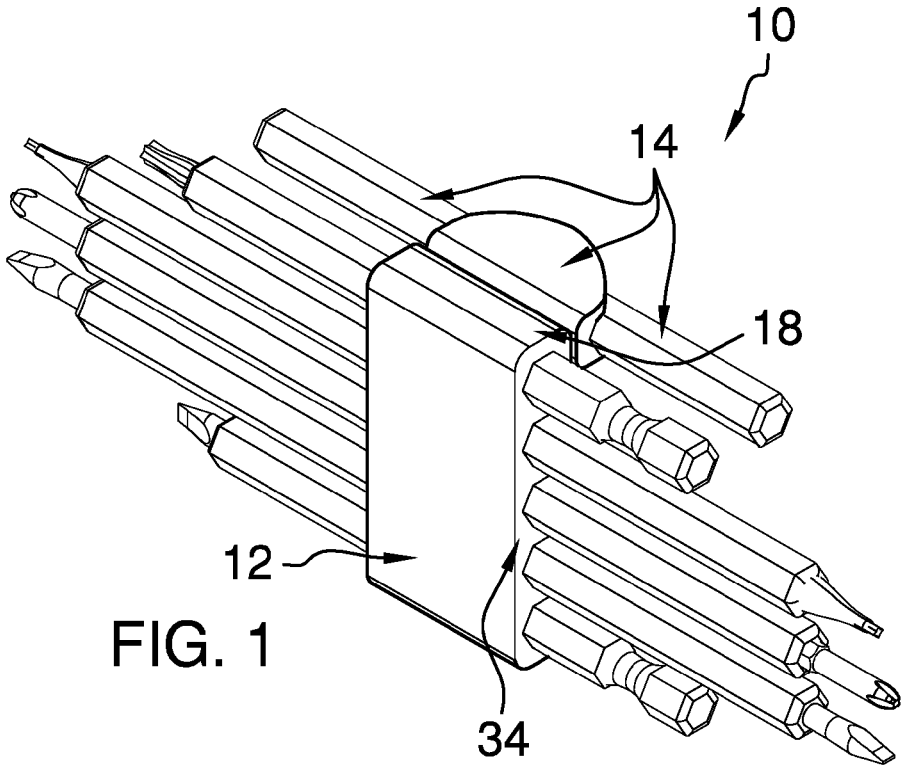
FIG. 1 is an isometric perspective view of a drill attachment storage device according to an embodiment of the disclosure.
Figure 2:
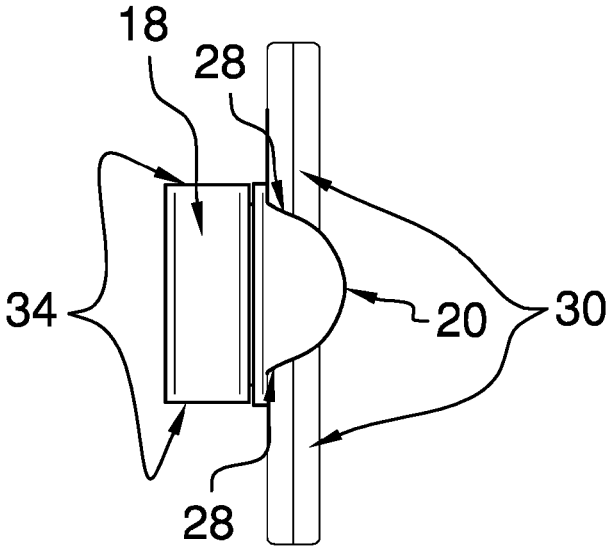
FIG. 2 is a top view of an embodiment of the disclosure.
Figure 3:
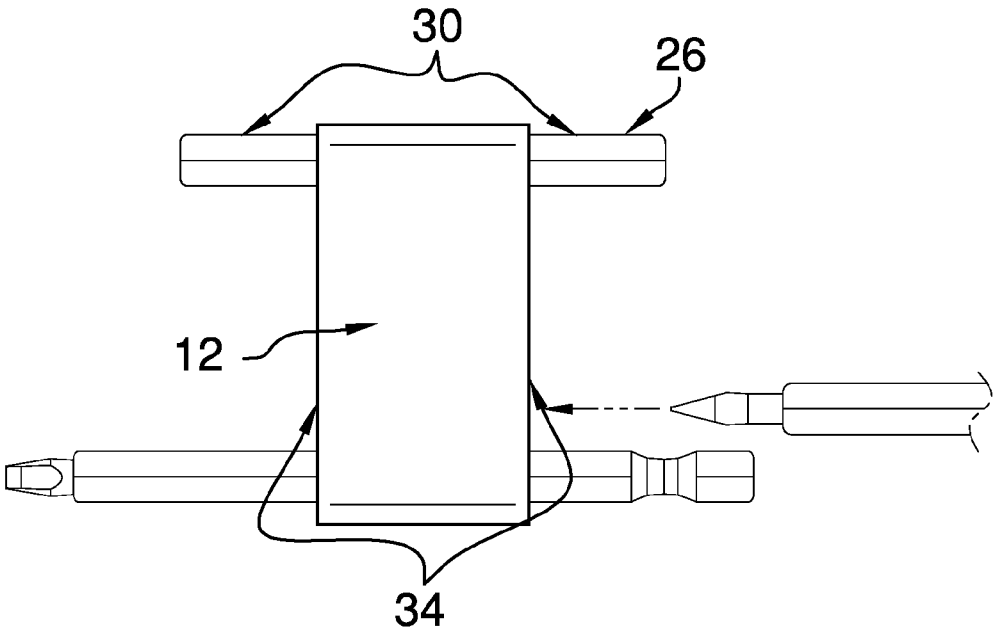
FIG. 3 is a front view of an embodiment of the disclosure.
Figure 4:
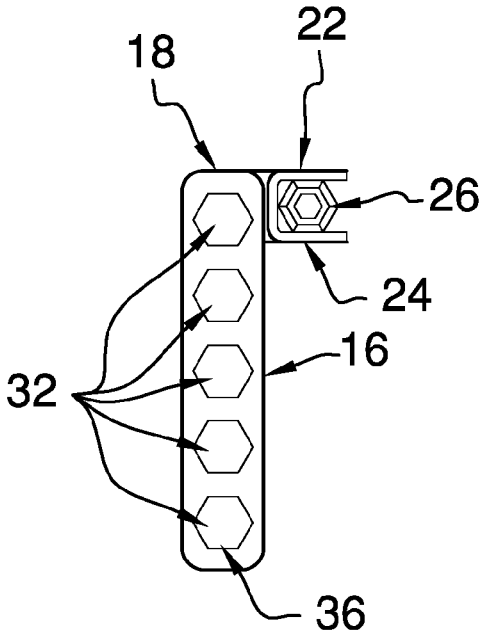
FIG. 4 is a side view of an embodiment of the disclosure.
Figure 5:
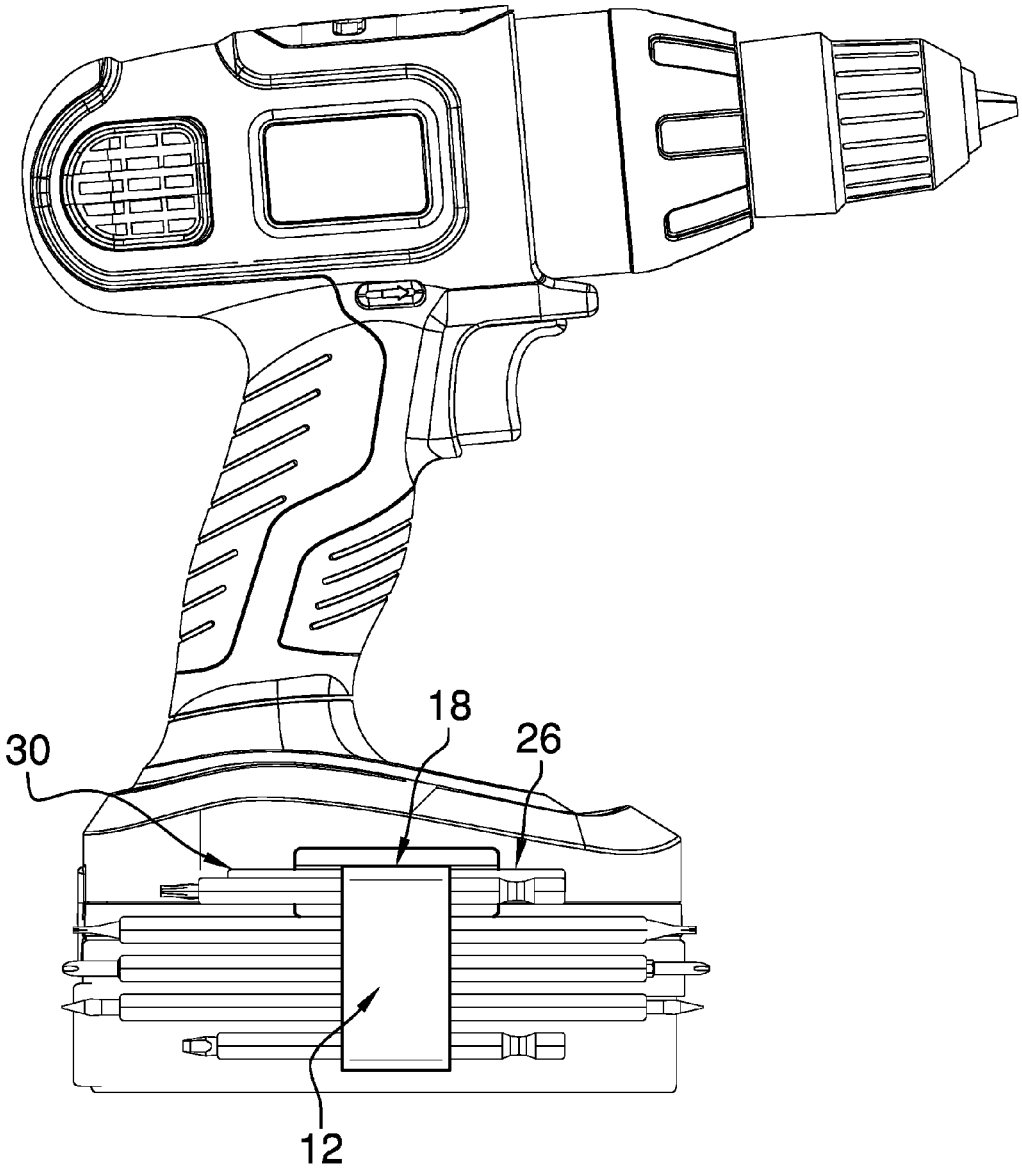
FIG. 5 is an in-use view of an embodiment of the disclosure.

With reference now to the drawings, and in particular to FIGS. 1 through 5 thereof, a new drill accessories embodying the principles and concepts of an embodiment of the disclosure and generally designated by the reference numeral 10 will be described.

As best illustrated in FIGS. 1 through 5, the drill attachment storage device 10 generally comprises a housing 12 that is substantially rectangularly box shaped and resilient. Preferably, the housing 12 comprises resilient plastic.

A coupler 14 is coupled to a back 16 of the housing 12 proximate to a top 18 of the housing 12, such that the coupler 14 is configured to reversibly couple to a drill. Preferably, the coupler 14 is configured to couple to a spare attachment fastener of the drill. More specifically, the coupler 14 comprises a central body 20 that is coupled to and extends transversely from the housing 12. The central body 20 comprises an upper arm 22 and a lower arm 24 that extend transversely from the back 16 of the housing 12. The upper arm 22 and the lower arm 24 are substantially semi-circularly shaped. A rod 26 is coupled to and positioned through the central body 20. The rod 26 extends beyond opposing edges 28 of the central body 20 defining exposed sections 30 of the rod 26. The rod 26 is coupled to the upper arm 22 and the lower arm 24, such that the exposed sections 30 of the rod 26 are substantially dimensionally equivalent. The rod 26 is substantially hexagonally shaped when viewed longitudinally. The exposed sections 30 of the rod 26 are configured to reversibly couple to the spare attachment fastener of the drill.

A plurality of penetrations 32 is positioned on opposing sides 34 of the housing 12 and extends through the housing 12. The penetrations 32 are complementary to a shaft of a drill attachment. Each penetration 32 is configured to reversibly couple a respective drill attachment. Each penetration 32 may be positioned substantially parallel to the rod 26 of the coupler 14, such that the penetrations 32 are configured to retain respective drill attachments substantially parallel to the rod 26. Each penetration 32 may be positioned substantially perpendicular to the rod 26 of the coupler 14, such that the penetrations 32 are configured to retain respective drill attachments substantially perpendicular to the rod 26.

The plurality of penetrations 32 comprises from four to twelve penetrations 32. Preferably, the plurality of penetration 32 comprises from six to ten penetrations 32. In a preferred embodiment, the plurality of penetrations 32 comprises ten penetrations 32. In another preferred embodiment, the plurality of penetrations 32 comprises six penetrations 32. The plurality of penetrations 32 may be positioned in a plurality of rows 36. The rows 36 are substantially parallel. Preferably, the plurality of rows 36 comprises one to two rows 36.

In use, each penetration 32 is configured to reversibly couple a respective drill attachment. The exposed sections 30 of the rod 26 are configured to reversibly couple to the spare attachment fastener of the drill. The housing 12 is positioned to store drill attachments such that the drill attachments are readily accessible to a user of the drill.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A drill attachment storage device comprising:

a coupler coupled to a back of a housing proximate to a top of said housing, said coupler being configured to couple to a spare attachment fastener of the drill, said coupler comprising a central body coupled to and extending transversely from said housing, a rod coupled to and positioned through said central body, said rod extending beyond opposing edges of said central body defining exposed sections of said rod, and wherein said exposed sections of said rod are configured to reversibly couple to the spare attachment fastener of the drill;

a plurality of penetrations positioned on opposing sides of housing and extending through said housing, said penetrations being complementary to a shaft of a drill attachment; and wherein each said penetration is configured to reversibly couple a respective drill attachment, wherein said coupler is configured to reversibly couple to a drill, wherein said housing is positioned to store drill attachments such that the drill attachments are readily accessible to a user of the drill.

2. The device of claim 1, further including said housing being substantially rectangularly box shaped.

3. The device of claim 1, further including said housing being resilient.

4. The device of claim 3, further including said housing comprising resilient plastic.

5. The device of claim 1, further including said central body comprising an upper arm and a lower arm extending transversely from said back of said housing.

6. The device of claim 5, further including said upper arm and said lower arm being substantially semi-circularly shaped.

7. The device of claim 5, further including said rod being coupled to said upper arm and said lower arm, such that said exposed sections of said rod are substantially dimensionally equivalent.

8. The device of claim 1, further including said rod being substantially hexagonally shaped when viewed longitudinally.

9. The device of claim 1, further including each said penetration being substantially parallel to said rod of said coupler, wherein said penetrations are configured to retain respective drill attachments substantially parallel to said rod.

10. The device of claim 1, further including each said penetration being substantially perpendicular to said rod of said coupler, wherein said penetrations are configured to retain respective drill attachments substantially perpendicular to said rod.

11. The device of claim 1, further including said plurality of penetrations comprising from four to twelve penetrations.

12. The device of claim 1, further including said plurality of penetrations being positioned in a plurality of rows, said rows being substantially parallel.

13. The device of claim 12, further including said plurality of rows comprising one to two rows.

14. A drill attachment storage device comprising:

a housing, said housing being substantially rectangularly box shaped, said housing being resilient, said housing comprising resilient plastic;

a coupler coupled to a back of said housing proximate to a top of said housing, wherein said coupler is configured to reversibly couple to a drill, said coupler being configured to couple to a spare attachment fastener of the drill, said coupler comprising:

a central body coupled to and extending transversely from said housing, said central body comprising an upper arm and a lower arm extending transversely from said back of said housing, said upper arm and said lower arm being substantially semi-circularly shaped, a rod coupled to and positioned through said central body, said rod extending beyond opposing edges of said central body defining exposed sections of said rod, said rod being coupled to said upper arm and said lower arm, such that said exposed sections of said rod are substantially dimensionally equivalent, said rod being substantially hexagonally shaped when viewed longitudinally, and wherein said exposed sections of said rod are configured to reversibly couple to the spare attachment fastener of the drill;

a plurality of penetrations positioned on opposing sides of housing and extending through said housing, said penetrations being complementary to a shaft of a drill attachment, wherein each said penetration is configured to reversibly couple a respective drill attachment, each said penetration being substantially parallel to said rod of said coupler, wherein said penetrations are configured to retain respective drill attachments substantially parallel to said rod, said plurality of penetrations being positioned in a plurality of rows, said rows being substantially parallel, said plurality of rows comprising one to two rows;

wherein each said penetration is configured to reversibly couple a respective drill attachment, wherein said exposed sections of said rod are configured to reversibly couple to the spare attachment fastener of the drill, wherein said housing is positioned to store drill attachments such that the drill attachments are readily accessible to a user of the drill.

15. The device of claim 14, further comprising:

each said penetration being substantially perpendicular to said rod of said coupler, wherein said penetrations are configured to retain respective drill attachments substantially perpendicular to said rod; and said plurality of penetrations comprising ten penetrations.

* * * * *